US011654328B2

(12) United States Patent
Tian et al.

(10) Patent No.: US 11,654,328 B2
(45) Date of Patent: May 23, 2023

(54) TREADMILL

(71) Applicant: Mo Technologies Co., Ltd., Shanghai (CN)

(72) Inventors: Wangui Tian, Shanghai (CN); Pingping Zheng, Shanghai (CN); Jian Xie, Shanghai (CN)

(73) Assignee: MO TECHNOLOGIES CO., LTD., Shanghai (CN)

( * ) Notice: Subject to any disclaimer, the term of this patent is extended or adjusted under 35 U.S.C. 154(b) by 85 days.

(21) Appl. No.: 17/334,852

(22) Filed: May 31, 2021

(65) Prior Publication Data

US 2021/0387043 A1 Dec. 16, 2021

(30) Foreign Application Priority Data

Jun. 12, 2020 (CN) ..... 202010535314.7

(51) Int. Cl.
*A63B 22/02* (2006.01)

(52) U.S. Cl.
CPC ..... *A63B 22/0235* (2013.01); *A63B 2210/56* (2013.01); *A63B 2225/09* (2013.01)

(58) Field of Classification Search
CPC ..... A63B 22/0235; A63B 2210/56; A63B 2225/09; A63B 2071/0081; A63B 2071/068; A63B 2210/58; A63B 2220/13; A63B 2225/50; A63B 22/02; A63B 71/06; A63B 24/0087; A63B 71/0054; A63B 2210/50; A63B 2220/808
See application file for complete search history.

(56) References Cited

U.S. PATENT DOCUMENTS

2003/0125165 A1* 7/2003 Trevino ..... A63B 22/0235 482/54
2003/0130094 A1* 7/2003 Tsou ..... A63B 22/02 482/54
2006/0252605 A1* 11/2006 Wang ..... A63B 22/0023 482/54
2009/0005224 A1* 1/2009 Davis ..... A63B 22/0257 482/54

(Continued)

FOREIGN PATENT DOCUMENTS

CN 209564566 U * 1/2019 ..... A63B 22/02

*Primary Examiner* — Andrew S Lo
*Assistant Examiner* — Andrew M Kobylarz
(74) *Attorney, Agent, or Firm* — IPro, PLLC

(57) ABSTRACT

The resent disclosure provides a treadmill, including a chassis, stand columns mounted at both sides of the chassis, a deck rotatably mounted on the chassis and configured to rotate relative to the chassis to a longitudinal direction or a horizontal direction, a handrail assembly rotatably mounted on the stand columns and configured to rotate relative to the stand columns to a folded state or an unfolded state, and a controller configured to control rotation of the deck and the handrail assembly. The controller is configured to control the deck to rotate to the longitudinal direction when the controller controls the handrail assembly to rotate relative to the stand columns to be in the folded state, and control the handrail assembly to rotate relative to the stand columns to be in the unfolded state when the controller controls the deck to rotate from the longitudinal direction to the horizontal direction.

14 Claims, 9 Drawing Sheets

(56) References Cited

U.S. PATENT DOCUMENTS

| | | | | |
|---|---|---|---|---|
| 2014/0121066 | A1* | 5/2014 | Huang | A63B 22/02 482/54 |
| 2017/0189744 | A1* | 7/2017 | Baker | A63B 69/0062 |
| 2017/0189745 | A1* | 7/2017 | Hamilton | A63B 22/0023 |

* cited by examiner

TREADMILL

CROSS-REFERENCE TO RELATED APPLICATION

This application claims a priority of the Chinese patent application No. 202010535314.7 filed on Jun. 12, 2020, which is incorporated herein by reference in its entirety.

TECHNICAL FIELD

The present disclosure relates to the field of fitness equipment, in particular to a treadmill.

BACKGROUND

In the related art, most of foldable treadmills are manually folded partially or fully through a mechanical rod or a hydraulic structure. Usually, it is impossible to automatically fold a deck of the treadmill. A user needs to take great effort to push the deck to be in an erect, folded state, and then lock it with a security lock. The entire operation is very difficult and complicated. In addition, the deck is relatively heavy, and an accident may easily occur in the case of misoperation. Moreover, based on a foldable structure of the conventional treadmill, a chassis of the treadmill may still occupy a large space even when the deck is folded to be in the erect state.

In addition, usually for the conventional foldable treadmill, merely the deck is pushed to be in the erect, folded state, but a handrail and a panel meter are fixedly mounted on a stand column. When the deck is being folded, the deck is related relative to the stand column and then erected. At this time, the handrail and the panel meter on the stand column are still in a fixed state and are not gathered.

Based on the above, even if the treadmill is in the folded state, the handrail and the chassis of the treadmill may still occupy a large space, and the entire appearance is not good.

Hence, there is an urgent need to provide a new treadmill to solve the above-mentioned problems.

SUMMARY

An object of the present disclosure is to provide a treadmill, so as to solve, or at least relieve, at least one of the above-mentioned problems.

The present disclosure provides in some embodiments a treadmill, including a chassis, stand columns mounted at both sides of the chassis, a deck rotatably mounted on the chassis and configured to rotate relative to the chassis to a longitudinal direction or a horizontal direction, a handrail assembly rotatably mounted on the stand columns and configured to rotate relative to the stand columns to a folded state or an unfolded state, and a controller configured to control rotation of the deck and the handrail assembly. The controller is configured to control the deck to rotate to the longitudinal direction when the controller controls the handrail assembly to rotate relative to the stand columns to be in the folded state, and control the handrail assembly to rotate relative to the stand columns to be in the unfolded state when the controller controls the deck to rotate from the longitudinal direction to the horizontal direction.

In a possible embodiment of the present disclosure, each stand column is rotatably connected to the chassis and configured to rotate by a predetermined angle relative to the chassis. Each stand column is oriented in a predetermined direction angled relative to the longitudinal direction at the predetermined angle when the deck is oriented in the horizontal direction. When the controller controls the deck to rotate to the longitudinal direction and the deck has rotated from the horizontal direction to the predetermined direction, the deck is configured to drive the stand columns and the handrail assembly on the stand columns to rotate synchronously by the predetermined angle to the vertical direction.

In a possible embodiment of the present disclosure, the treadmill further includes a handrail motor coupled to the handrail assembly and configured to drive the handrail assembly to rotate, and a pushrod motor coupled to the deck and configured to drive the deck to rotate. The controller includes a first control panel coupled to the handrail motor and configured to control the handrail motor so that the handrail motor drives the handrail assembly to rotate, and a second control panel coupled to the first control panel and the pushrod motor and configured to control the pushrod motor so that the pushrod motor drives the deck to rotate.

In a possible embodiment of the present disclosure, the treadmill further includes a first sensor coupled to the controller and configured to detect whether there is a human body spaced apart from the treadmill by a predetermined distance when the deck rotates, and when there is the human body spaced apart from the treadmill by the predetermined distance, transmit a corresponding electric signal to the controller so that the controller controls the deck to stop rotating.

In a possible embodiment of the present disclosure, the first sensor is further configured to, when there is no human body spaced apart from the treadmill by the predetermined distance, transmit the first electric signal to the controller, and the controller is further configured to wait a predetermined time period and control the deck to rotate continuously upon the receipt of the first electric signal.

In a possible embodiment of the present disclosure, the treadmill further includes a second sensor coupled to the controller and configured to detect whether the treadmill is in a stable state when the deck rotates, and when the treadmill is in an unstable state, transmit a second electric signal to the controller so that the controller controls the deck to stop rotating.

In a possible embodiment of the present disclosure, the treadmill further includes a microphone configured to receive a voice command, and a voice controller coupled to the microphone and the controller and configured to parse the voice command received by the microphone and transmit the parsed voice command to the controller so that the controller controls the treadmill in accordance with the parsed voice command.

In a possible embodiment of the present disclosure, a support plate is arranged at an upper end of each stand column. The handrail assembly includes a handrail mounted on the support plate and configured to rotate relative to the support plate, and a panel including a panel bracket. A toothed disc is secured onto the panel bracket, rotatably connected to the support plate, and configured to drive the panel bracket and the panel to rotate relative to the support plate. The handrail motor is fixedly mounted on the handrail, connected to the toothed disc, and configured to drive the handrail and the toothed disc to rotate in opposite directions.

In a possible embodiment of the present disclosure, an arc-like stopping hole is provided in the support plate, and a stopping rod is fixedly mounted on the handrail. When the handrail rotates relative to the support plate, the stopping rod is configured to move along the stopping hole to abut against any one of two ends of the stopping hole.

In a possible embodiment of the present disclosure, a stopping stud is fixedly mounted on the support plate, and a first stopping groove is formed in the toothed disc. When the toothed disc rotates relative to the support plate, the stopping stud is configured to move along the first stopping groove to abut against any one of two ends of the first stopping groove.

In a possible embodiment of the present disclosure, the chassis includes a fixed bracket, and a telescopic bracket slidably mounted on the fixed bracket and configured to move horizontally relative to the fixed bracket. The deck is rotatably mounted on the fixed bracket and connected to the telescopic bracket through a connection rod. The telescopic rod is configured to drive the deck to rotate relative to the fixed bracket through the connection rod when the telescopic rod moves horizontally relative to the fixed bracket.

In a possible embodiment of the present disclosure, the pushrod motor is fixedly mounted on the fixed bracket, connected to the telescopic bracket, and configured to drive the telescopic bracket to move horizontally relative to the fixed bracket.

In a possible embodiment of the present disclosure, a fixed plate is arranged on the chassis, a second stopping groove is provided in the fixed plate, a rotation groove is provided in the deck, and the stand column is provided with a stopping shaft. The stopping shaft penetrates through the second stopping groove into the rotation groove, and is configured to rotate relative to the second stopping groove and the rotation groove. When the deck rotates from the horizontal direction to the predetermined direction relative to the stand column and the stopping shaft, the stopping shaft moves from a first end of the rotation groove to a second end of the rotation groove and abuts against the second end, so that the deck pushes the stand column to rotate synchronously. When the deck pushes the stand column to rotate from the predetermined direction to the longitudinal direction, the stopping shaft rotates from the first end of the second stopping groove to the second end of the second stopping groove.

According to the embodiments of the present disclosure, the treadmill includes the chassis, the deck, the stand columns, the handrail assembly and the controller. The deck is capable of rotating relative to the chassis to be in the folded state in the longitudinal direction or the unfolded state in the horizontal direction. The handrail assembly is capable of rotating relative to the stand column to be in the folded state or the unfolded state, and the stand column is capable of rotating to the longitudinal direction. When the controller controls the deck to rotate to be in the folded state in the longitudinal direction, the handrail assembly and the stand column may also rotate to the longitudinal direction under the effect of the deck, and at this time the handrail assembly may also be in the folded state. As a result, through the cooperation of a control assembly and a structural assembly, it is able to rotate the deck, the handrail assembly and the stand columns to the horizontal direction and fold the entire treadmill, thereby to provide a more compact structure after the folding, reduce a space occupied by the folded treadmill, and automatically fold the deck.

Further, through the stopping structures, it is able to rotate the deck, the stand columns and the handrail assembly stably during the folding, and automatically lock them at corresponding positions stably, thereby to improve the stability of the entire treadmill in the folded or unfolded state, and improve the security.

In addition, the chassis may include the fixed bracket and the telescopic bracket capable of horizontally sliding relative to the fixed bracket. The telescopic bracket may be driven to slide along the fixed bracket, so as to drive the deck to rotate relative to the fixed bracket to the longitudinal direction. Based on the above, when the deck rotates to be in the folded state in the longitudinal direction, the telescopic bracket may also contract relative to the fixed bracket, so as to dynamically adjust a center of gravity and ensure the stability of the deck when folding the deck, and reduce a space occupied by the deck in the folded state. Moreover, when the deck rotates to be in the unfolded state in the horizontal direction, the telescopic bracket may stretch relative to the fixed bracket, so as to stably support the deck and improve the stability of the treadmill.

The above description is merely an overview of the schemes in the embodiments of the present disclosure, and the schemes may be implemented in accordance with contents involved in the description so as to enable a person skilled in the art to understand the technical means of the present disclosure in a clearer manner. In order to make the objects, the technical solutions and the advantages of the present disclosure more apparent, the present disclosure will be described hereinafter in a clear and complete manner in conjunction with the drawings and embodiments.

BRIEF DESCRIPTION OF THE DRAWINGS

In order to achieve the above and related objects, some descriptive aspects will be described in conjunction with the following description and drawings, and these aspects indicate various ways capable of practicing a principle of the present disclosure. All aspects and equivalent aspects thereof shall fall within the scope of the present disclosure. The above and other objects, features and advantages will become more apparent on the basis of the drawings in conjunction with the following description. Same reference signs represent a same component or element.

DETAILED DESCRIPTION

The present disclosure will be described hereinafter in more details in conjunction with the drawings and embodiments. The following embodiments are for illustrative purposes only, but shall not be used to limit the scope of the present disclosure. In contrast, the following embodiments are provided so as to facilitate the understanding of the present disclosure.

Figure 1:
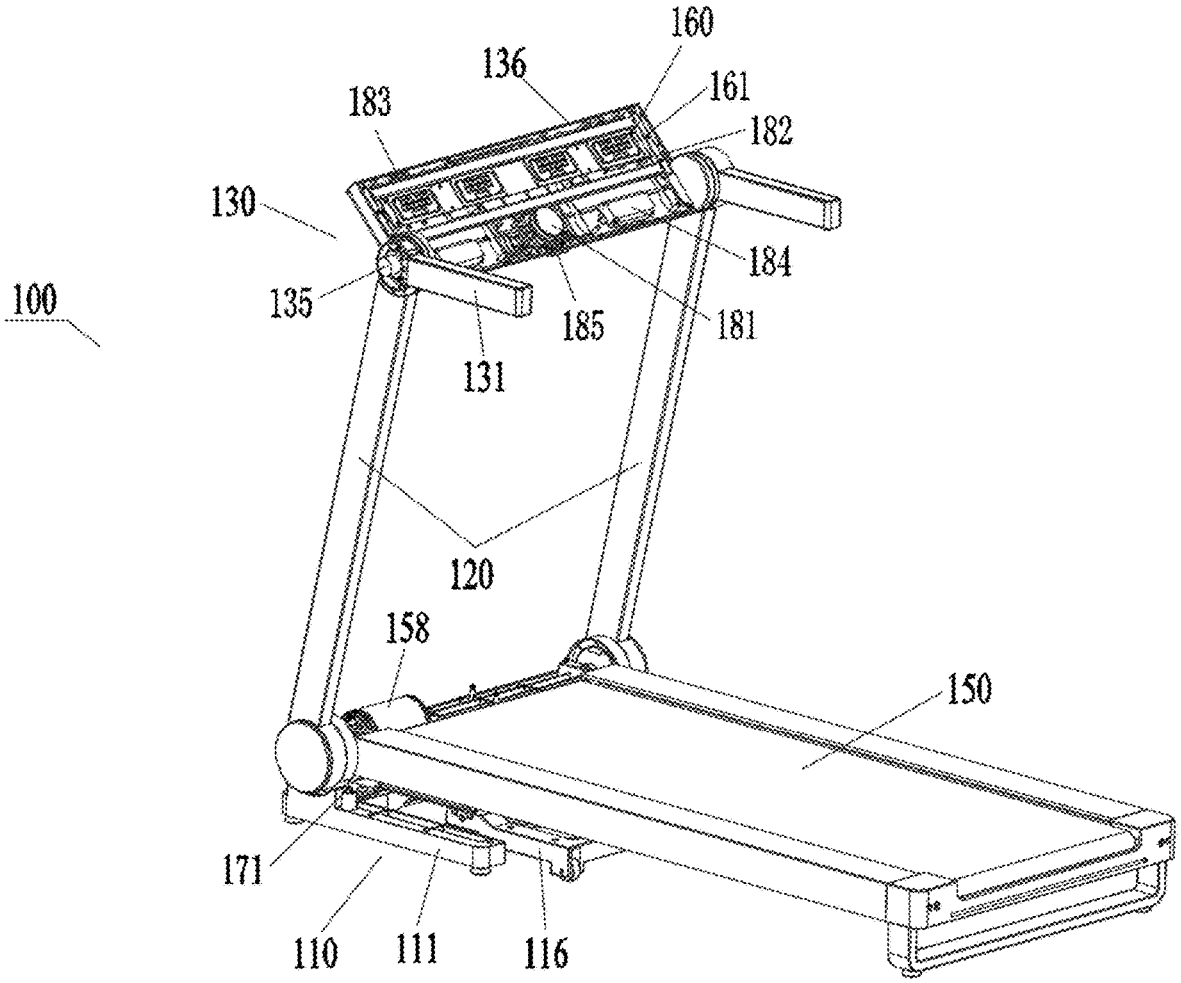
FIG. 1 is a schematic view showing a treadmill 100 in an unfolded state according to one embodiment of the present disclosure.

In order to solve the problems in a conventional treadmill, the present disclosure provides in some embodiments a treadmill 100 which is capable of being folded or unfolded automatically, so as to reduce a space occupied by the treadmill in a folded state. FIG. 1 shows the treadmill 100 in an unfolded state, and FIG. 2 shows the treadmill 100 in the folded state.

Figure 2:
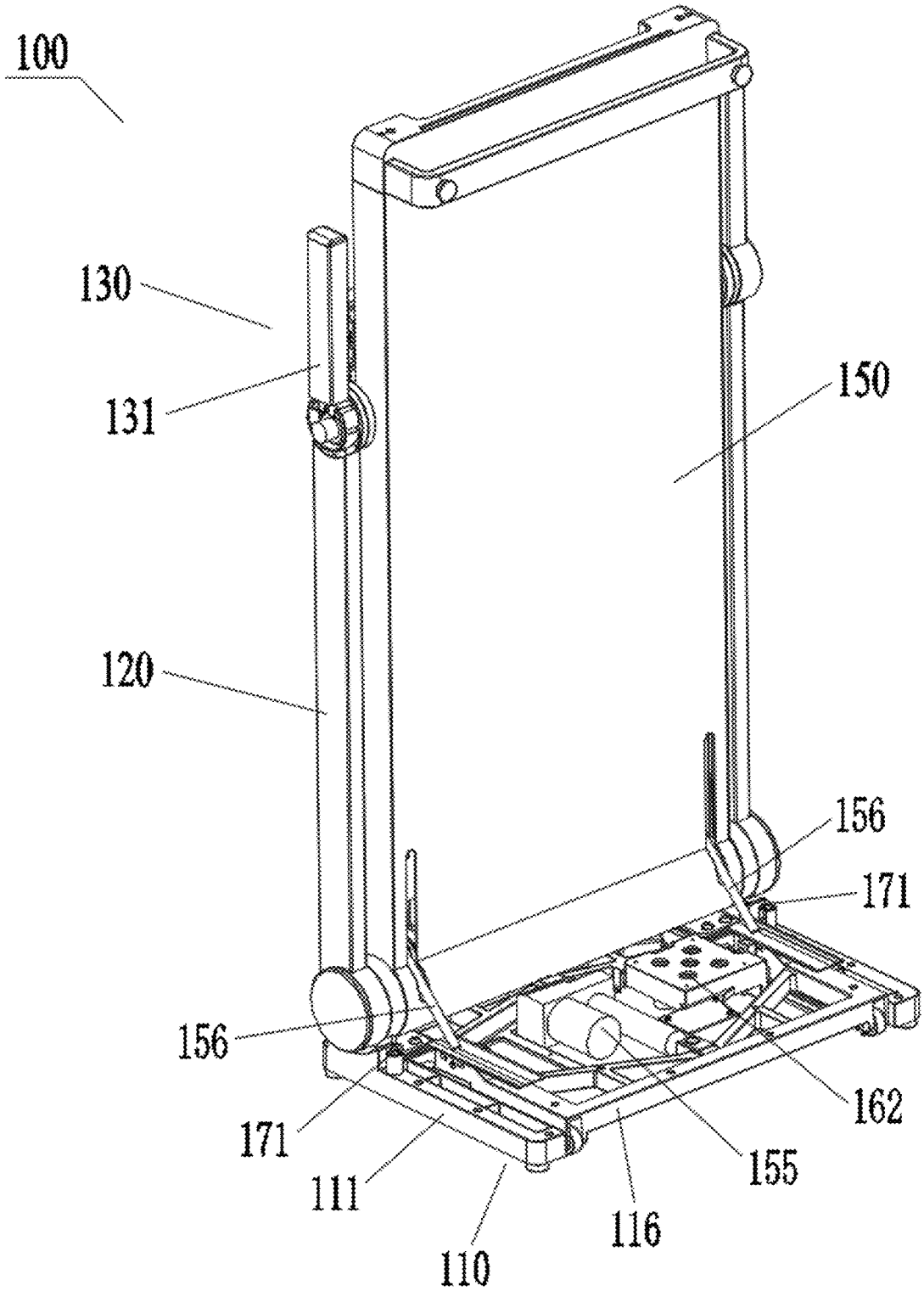
FIG. 2 is a schematic view showing the treadmill 100 in the folded state according to one embodiment of the present disclosure.

As shown in FIGS. 1 and 2, the treadmill 100 includes a chassis 110, a deck 150, and two stand columns 120 arranged at two sides of the chassis 110 and the deck 150. A lower end of the deck 150 is rotatably mounted on a front end of the chassis 110, and the deck 150 may rotate relative to the chassis 110 to a longitudinal direction or a horizontal direction.

The two stand columns 120 may be rotatably connected to the front end of the chassis 110, and rotate relative to the chassis 110 by a predetermined angle. To be specific, as shown in FIG. 2, each stand column 120 may be oriented in the longitudinal direction. As shown in FIG. 1, each stand column 120 may be oriented in a predetermined direction angled relative to the longitudinal direction by a predetermined angle. Here, the predetermined angle and an angle by which the stand column 120 relative to the chassis will not be particularly defined herein.

In addition, the treadmill 100 further includes a handrail assembly 130 arranged on an upper end of each stand column 120. The handrail assembly 130 may be rotatably mounted on the stand column 120, and rotate relative to the stand column 120 to be in the folded state or the unfolded state. To be specific, as shown in FIG. 2, when the treadmill 100 is in the folded state, the handrail assembly 130 may rotate to be in the folded state, and as shown in FIG. 1, when the treadmill 100 is in the unfolded state, the handrail assembly 130 may rotate to be in the unfolded state.

In other words, in the embodiments of the present disclosure, when the treadmill 100 is in the unfolded state, the deck 150 may be oriented in the horizontal direction, each stand column 120 may be oriented in the predetermined direction angled relative to the longitudinal direction by the predetermined angle, and the handrail assembly 130 may be in the folded state. When the treadmill 100 is in the folded state, the deck 150 and the stand columns 120 may be oriented in the longitudinal direction, and the handrail assembly 130 may be in the unfolded state.

In a possible embodiment of the present disclosure, the treadmill 100 further includes a controller 160 configured to control structural components of the treadmill 100. The controller 160 may control rotation of the deck 150 and the handrail assembly 130, so as to automatically fold or unfold the treadmill 100. Here, a position of the controller 160 will not be particularly defined.

To be specific, when the treadmill 100 is to be automatically folded (i.e., the treadmill 100 is to be switched from the unfolded state to the folded state), the controller 160 may control the handrail assembly 130 to rotate relative to the stand column 120 to be in the folded state, and at this time, the stand column 120 may be always oriented in the predetermined direction angled relative to the longitudinal direction by the predetermined angle. Then, the controller may control the deck 150 to rotate from the horizontal direction to the longitudinal direction. Here, it should be appreciated that, when the controller 160 controls the deck 150 to rotate to the longitudinal direction and the deck 150 has rotated from the horizontal direction to the predetermined direction where the stand column 120 is oriented, the deck 150 may drive the stand column 120 and the handrail assembly 130 on the stand column 120 to rotate synchronously by the predetermined angle to the longitudinal direction.

When the treadmill 100 is to be automatically unfolded, the controller 160 may control the deck 150 to rotate from the longitudinal direction to the horizontal direction, and then control the handrail assembly 130 to rotate relative to the stand column 120 to be in the unfolded state. Here, it should be appreciated that, when the deck 150 rotates from the longitudinal direction to the predetermined direction, the stand column 120 may drive the handrail assembly 130 to rotate synchronously to the predetermined direction, and at this time the handrail assembly 130 may be always in the folded state. In addition, the stand column 120 may be fixed at a position in the predetermined direction and may not rotate any more, and the deck 150 may rotate continuously rotate from the predetermined direction to the horizontal direction. After the deck 150 has rotated to the horizontal direction, the controller 160 may control the handrail assembly 130 (on the stand column 120 in the predetermined direction) to rotate relative to the stand column 120, so as to be switched from the folded state to the unfolded state.

In a possible embodiment of the present disclosure, as shown in FIG. 2, when the handrail assembly 130 is in the folded state, it may be oriented in a same direction as the stand column 120, i.e., it may overlap the stand column 120, so as to reduce the space occupied by the treadmill 100 in the folded state.

Figure 5:
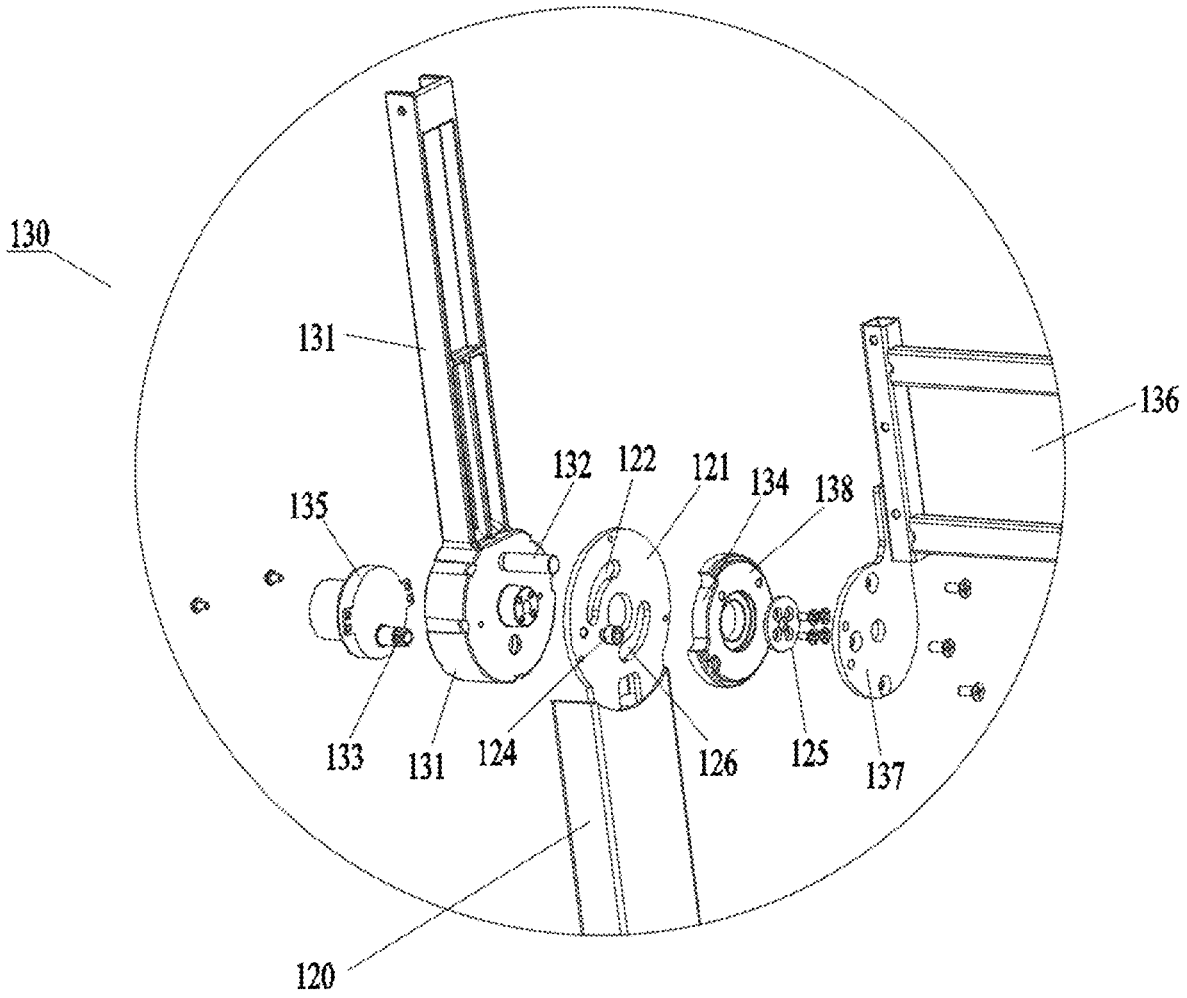
FIGS. 5 and 6 are exploded views of a handrail assembly 130 according to one embodiment of the present disclosure.
Figure 6:
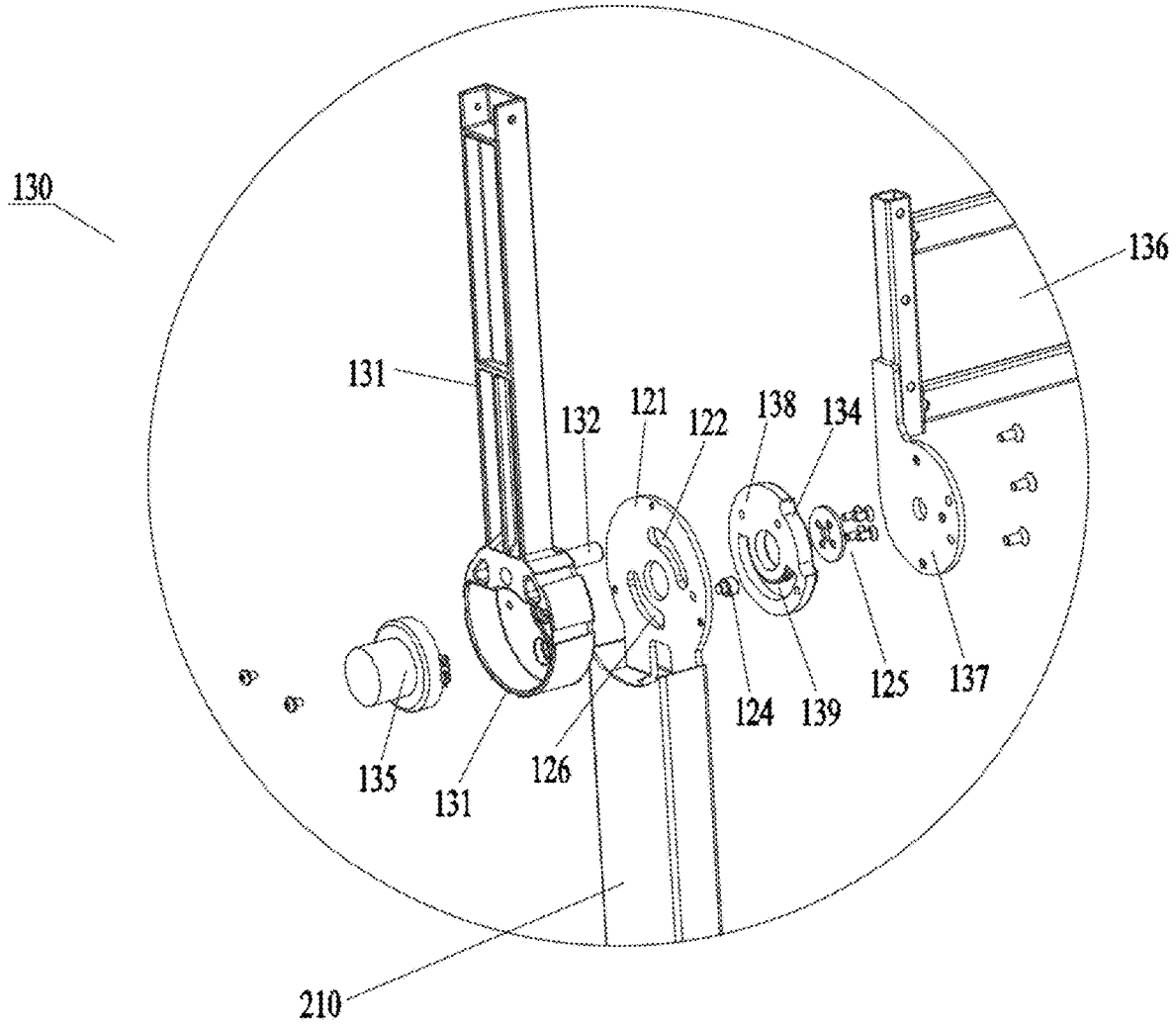

FIGS. 5 and 6 are exploded views of the handrail assembly 130 according to one embodiment of the present disclosure.

As shown in FIGS. 5 and 6, a support plate 121 is fixedly mounted on the upper end of the stand column 120, and the handrail assembly 130 is mounted on the support plate 121 and may rotate relative to the support plate 121.

The handrail assembly 130 includes a handrail 131 and a panel 136, and the handrail 131 is rotatably connected to the support plate 121. The panel 136 includes a panel bracket 137, and a toothed disc 138 is fixedly mounted on the panel bracket 137 and rotatably connected to the support plate 121 through the toothed disc 138. When the toothed disc 138 rotates relative to the support plate 121, it may drive the panel bracket 137 and the panel 136 to rotate relative to the support plate 121. Here, a specific structure for rotatably connecting the handrail 131 and the toothed disc 138 to the support plate 121 will not be particularly defined herein. In a possible embodiment of the present disclosure, the handrail 131 and the toothed disc 138 may be rotatably connected to the support plate 121 through a locking member 125. Through the locking member 125, the handrail 131 and the panel 136 may be mounted at both sides of the support plate 121 respectively.

It should be appreciated that, the panel 136 and the handrail 131 may rotate relative to the support plate 121 in opposite directions, so as to move close to or away from each other, i.e., to enable the handrail assembly 130 to be in the folded state or the unfolded state.

In a possible embodiment of the present disclosure, the treadmill 100 includes a handrail motor 135 and a pushrod motor 155. The handrail motor 135 is coupled to the handrail assembly 130, and configured to drive the handrail assembly 130 to rotate. The pushrod motor 155 is coupled to the deck 150, and configured to drive the deck 150 to rotate. In addition, the handrail motor 135 and the pushrod 155 are coupled to the controller 160, so that the controller 160 controls the handrail motor 135 to control the rotation of the handrail assembly 130 (i.e., control the panel 136 and the handrail 131 to rotate in opposite directions relative to the support plate 121), and controls the pushrod 155 to control the rotation of the deck 150.

To be specific, as shown in FIGS. 5 and 6, the handrail motor 135 is fixedly mounted on the handrail 131, and connected to the toothed disc 138. The toothed disc 138 is provided with teeth 139 arranged along an arc, and the handrail motor 135 includes a gear shaft 133 which penetrates through an avoidance hole 126 in the support plate 121 in an axial direction and engages with the teeth 139 on the toothed disc 138. When the handrail motor 135 drives the handrail 131 to rotate relative to the support plate 121, through the engagement of the gear shaft 133 with the teeth 139 on the tooted disc, the toothed disc 138 may be driven to rotate in an opposite direction. In other words, the handrail motor 135 may drive the handrail 131 and the toothed disc 138 to rotate in opposite directions. The controller 160 may control the handrail motor 135, so as to control the handrail 131 and the panel 136 to rotate relative to the support plate 121 in opposite directions to move close to or move away from each other.

In a possible embodiment of the present disclosure, as shown in FIGS. 5 and 6, an arc-like stopping hole 122 is provided in the support plate 121, and a stopping rod 132 adapted to the stopping hole 122 is fixedly provided on the handrail 131. The stopping rod 132 is fixedly arranged at an end surface of the handrail 131 opposite to the support plate, extends along a direction perpendicular to the support plate 121 (a direction parallel to an axis direction of the support plate 121), and passes through the stopping hole 122 in the support plate 121. When the handrail 131 rotates relative to the support plate 121, the stopping rod 132 may move along the stopping hole 122. When the stopping rod 132 moves to abut against any one of two ends of the stopping hole 122, the stopping rod 132 may stop, and the handrail 131 may not rotate relative to the support plate 121 and may stop at the position.

In a possible embodiment of the present disclosure, as shown in FIGS. 5 and 6, a stopping stud 124 is further fixedly mounted on the support plate 121, and a first stopping groove 134 adapted to the stopping stud 124 is provide din the toothed disc 138. When the toothed disc 138 rotates relative to the support plate 121, the stopping stud 124 on the support plate 121 may rotate relative to the toothed disc 138 and move along the first stopping groove 134 in the toothed disc 138. When the stopping stud 124 moves to abut against any one of two ends of the first stopping groove 134, the stopping stud 124 may be stopped, and thereby the rotation of the support plate 121 relative to the toothed disc 138 may be limited. At this time, the toothed disc 138 and the panel 136 may not rotate relative to the support plate 121 any more and may stop at the position. In a possible embodiment of the present disclosure, the first stopping groove 134 is formed in a peripheral portion of the toothed disc 138, i.e., it is a notch formed in the peripheral portion of the toothed disc 138.

When the handrail assembly 130 is in the folded state, the handrail 131 and panel 136 may rotate to a direction in alignment with the stand column 120, and an angle between the handrail 131 and the stand column 120 and an angle between the panel 136 and the stand column 120 (the support plate 121) may each be 0°. At this time, the stopping rod 132 on the handrail 131 may rotate to abut against a first end of the stopping hole 113 in the support plate 121, so as to prevent the handrail 131 from rotating relative to the support plate 121, and stop the handrail 131 at the position. In addition, the stopping stud 124 on the support plate 121 may rotate to abut against a first end of the first stopping groove 134 in the toothed disc 138, so as to prevent the rotation of the support plate 121 relative to the toothed disc 138 and stop the toothed disc 138 and the panel 136 at the corresponding positions.

When the handrail assembly 130 is in the unfolded state, i.e., when the handrail 131 and the panel 136 rotate to move away from each other (in the opposite directions), the handrail 131 and the panel 136 may each rotate to a position angled relative to the stand column 120 (the support plate 121) at a certain angle. At this time, the stopping rod 132 on the handrail 131 may rotate to abut against a second end of the stopping hole 113 in the support plate 121, so as to prevent the handrail 131 from rotating relative to the support plate 121 and stop the handrail 131 at the position. In addition, the stopping stud 124 on the support plate 121 may rotate to abut against a second end of the first stopping groove 134 in the toothed disc 138, so as to prevent the rotation of the support plate 121 relative to the toothed disc 138 and stop the toothed disc 138 and the panel 136 at the corresponding positions. Here, an angle between the handrail 131 and the stand column 120 and an angle between the panel 136 and the stand column 120 in the unfolded state will not be particularly defined herein, and they may be set according to the practical needs and an ergonomics requirement.

Through the above-mentioned stopping structure, the handrail 131 and the panel 136 may be in the folded state or the unfolded state stably. In this way, no matter whether the treadmill is in the folded state or the unfolded state, it is able to ensure the stability of the entire treadmill. In addition, when the treadmill is in the folded state, the panel 136 and the handrail 131 may move close to each other to be in alignment with the stand column 120, so as to reduce the space occupied by the treadmill in the folded state and improve the appearance thereof.

Figure 3:
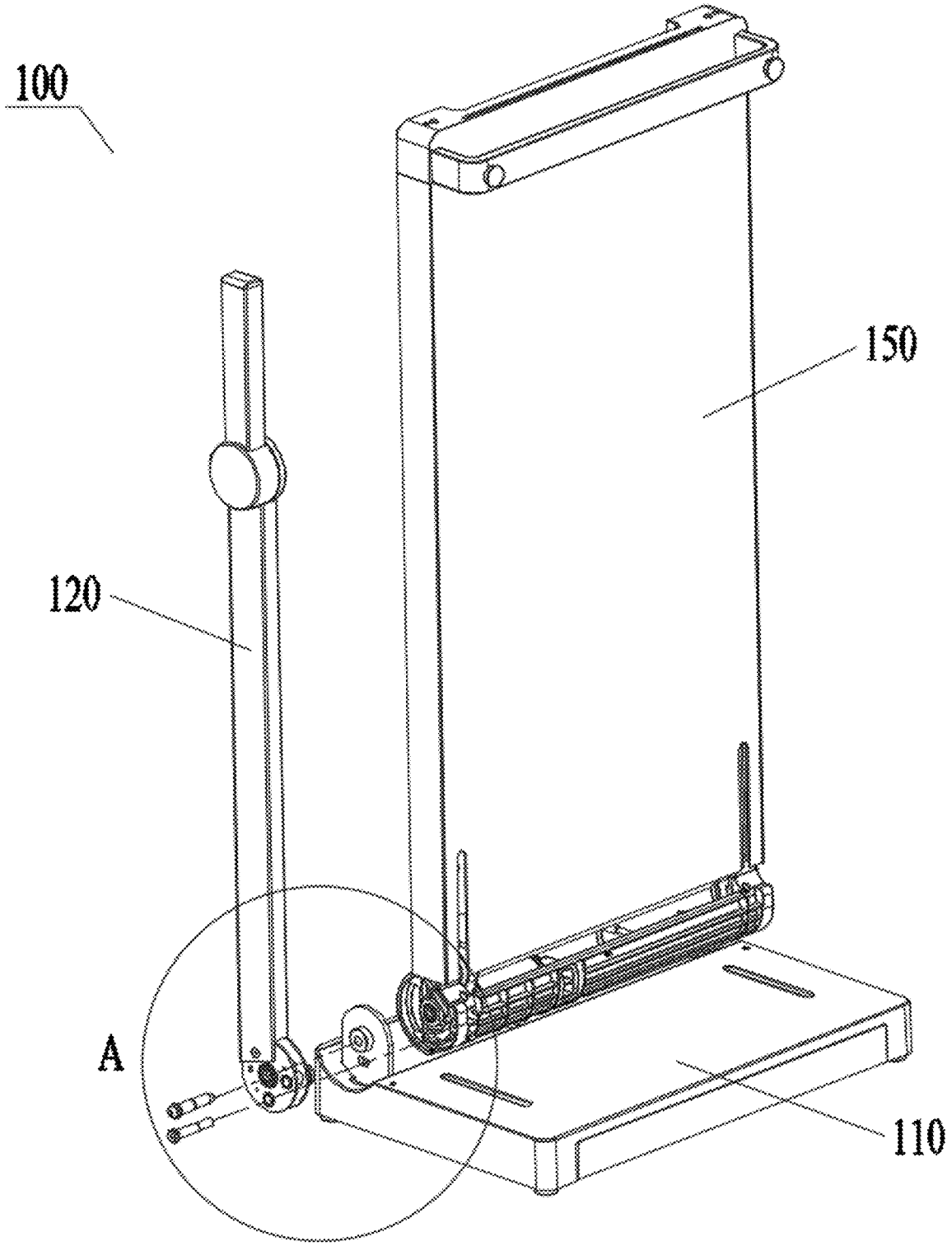
FIG. 3 is a schematic view showing a structure consisting of a stand column 120, a deck 150 and a chassis 110 according to one embodiment of the present disclosure.
Figure 4:
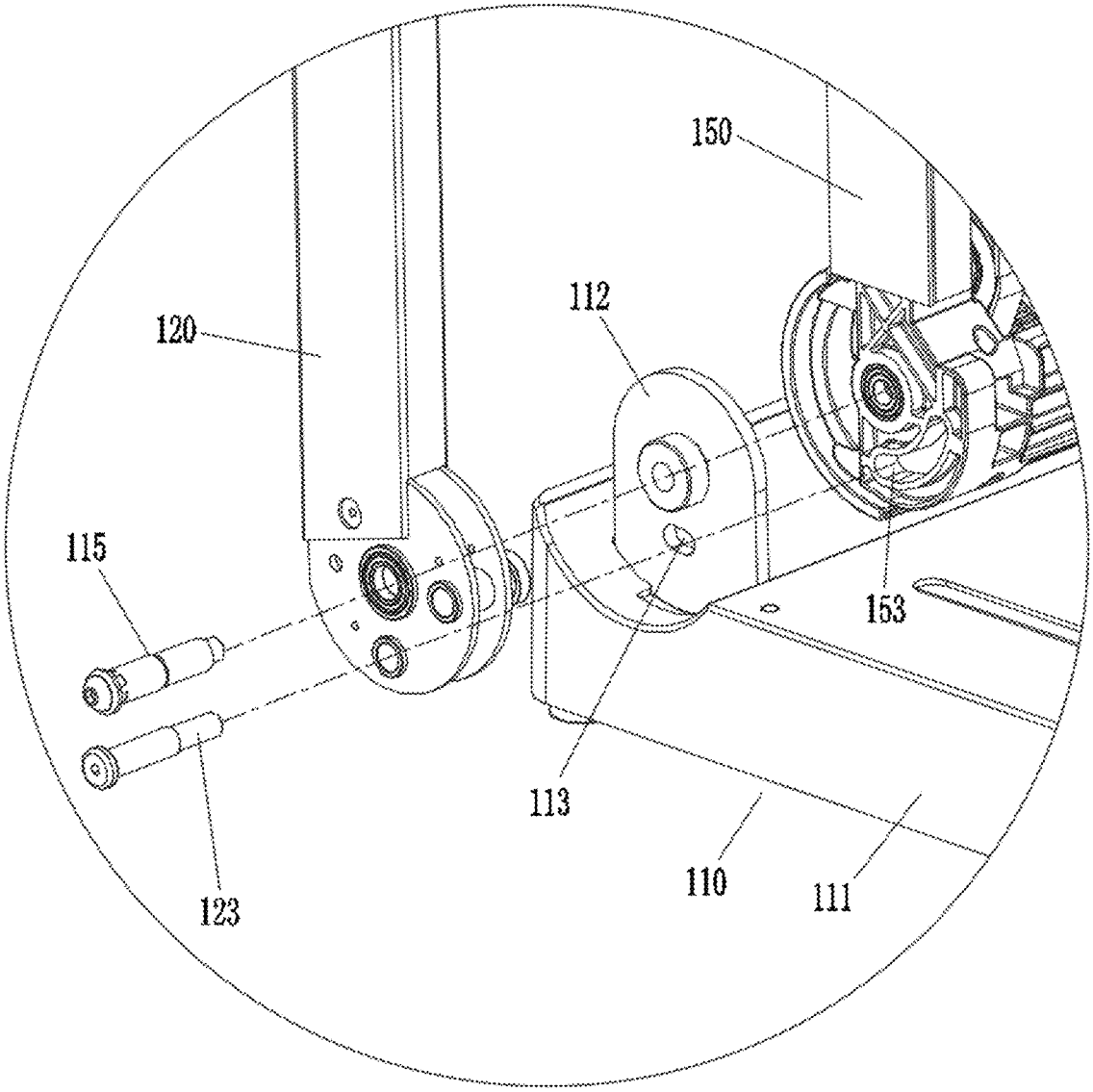
FIG. 4 is an enlarged view of A in FIG. 3.

FIGS. 3 and 4 show a structure consisting of the stand column 120, the deck 150 and the chassis 110 according to one embodiment of the present disclosure.

As shown in FIGS. 3 and 4, the chassis 110 includes a fixed bracket 111 and a telescopic bracket 116. The telescopic bracket 116 is slidably mounted on the fixed bracket 111, and may move horizontally relative to the fixed bracket 111. The deck 150 and the stand column 120 may be rotatably mounted on the fixed bracket 111.

In a possible embodiment of the present disclosure, as shown in FIG. 4, fixed plates 112 are arranged at two sides of a front end of the fixed bracket 111, and two sides of the front end of the deck 150 are rotatably connected to the two fixed plates 112 via connection shafts 115, so as to rotatably mount the deck 150 between the two fixed plates 112. A lower end of each stand column 120 is rotatably connected to the corresponding fixed plate 112 through the connection shaft 115, so that the stand column 120 may rotate to the longitudinal direction or the predetermined direction relative to the fixed plate 112.

The deck 150 is connected to the telescopic bracket 116 through a connection rod 156, and two ends of the connection rod 156 are pivotally connected to the deck 150 and the telescopic bracket 116 respectively. In this way, when the telescopic bracket 116 moves horizontally relative to the fixed bracket 111, the deck 150 may be driven to rotate relative to the fixed bracket 111 and the fixed plate 112 through the connection rod 156, and the deck 150 may be driven to rotate to the longitudinal direction or the horizontal direction relative to the fixed bracket 111 and the fixed plate 112, so as to enable the treadmill to be in the folded state or the unfolded state. To be specific, when the telescopic bracket 116 moves horizontally in a direction close to the fixed bracket 111, the deck 150 may be driven to rotate to the longitudinal direction relative to the fixed bracket 111, and when the telescopic bracket 116 moves horizontally in a direction away from the fixed bracket 111, the deck 150 may be driven to rotate to the horizontal direction relative to the fixed bracket 111.

In a possible embodiment of the present disclosure, as shown in FIG. 2, the pushrod motor 155 is fixedly mounted on the fixed bracket 111, and connected to the telescopic bracket 116. The controller 160 may control the pushrod motor 155 to drive the telescopic bracket 116 to move horizontally relative to the fixed bracket 111, so as to drive the deck 150 to rotate relative to the fixed bracket 111 and the fixed plate 112 through the connection rod 156. In other words, in the embodiments of the present disclosure, the controller 160 may control the pushrod motor 155 to drive the telescopic bracket 116 to move, so as to control the rotation of the deck 150 relative to the chassis 110.

Based on the above, when the deck 150 rotates to be in the folded state in the longitudinal direction, the telescopic bracket 116 may contract relative to the fixed bracket 111, so as to dynamically adjust the center of gravity of the deck 150 during the folding, ensure the stability of the deck 150, and reduce the space occupied by the deck 150 in the folded state. When the deck 150 rotates to be in the unfolded state in the horizontal direction, the telescopic bracket 116 may stretch relative to the fixed bracket 111, so as to stably support the deck 150 and improve the stability of the treadmill 100 in use.

In a possible embodiment of the present disclosure, as shown in FIGS. 3 and 4, a second stopping groove 113 is provided in the fixed plate 112, a rotation groove 153 is provided in the deck 150, and a stopping shaft 123 is provided at the lower end of the stand column 120. The stopping shaft 123 penetrates through the second stopping groove 113 in the fixed plate 112 into the rotation groove 153 in the deck 150. The stopping shaft 123 may rotate relative to the second stopping groove 113 and the rotation groove 153.

To be specific, when the deck 150 rotates from the horizontal direction to the predetermined direction, it may rotate relative to the stand column 120 and the stopping shaft 123 on the stand column, so the stopping shaft 123 may move relative to the rotation groove 153. In addition, when the deck 150 has rotated from the horizontal direction to the predetermined direction, the stopping shaft 123 may just move from a first end of the rotation groove 153 to a second end of the rotation groove 153 and abut against the second end (at this time, the deck 150 and the stand column 120 may be both oriented in the predetermined direction). In this way. When the deck 150 continuously rotates from the predetermined direction to the longitudinal direction, the stand column 120 may be stopped from rotating relative to the deck 150 because the stopping shaft abuts against the second end of the rotation groove 153, and thereby the deck 150 may push the stand column 120 to rotate to the longitudinal direction through the second end of the rotation groove 153.

When the deck 150 pushes the stand column 120 to rotate from the predetermined direction to the longitudinal direction, the stand column 120 and the stopping shaft 123 on the stand column may rotate relative to the fixed plate 112, so the stopping shaft 123 may move relative to the second stopping groove 113. In addition, when the deck 150 pushes the stand column 120 to rotate from the predetermined direction to the longitudinal direction, the stopping shaft 123 on the stand column 120 may just rotate from a first end of the second stopping groove 113 to a second end of the second stopping groove 113. In this way, the stand column 120 may be stopped from rotating relative to the fixed plate 112 because the stopping shaft 123 on the stand column 120 abuts against the second end of the second stopping groove 113, and the stand column 120 may be stopped at the position, i.e., the stand column 120 may be locked to be oriented in the longitudinal direction.

It should be appreciated that, when the stand column 120 rotates to the longitudinal direction, the stopping shaft 123 on the stand column 120 may abut against the second end of the rotation groove 153 (a front end of the rotation groove 153) and abut against the second end of the second stopping groove 113 (a rear end of the second stopping groove 113), so as to stably lock the stand column 120 to be oriented in the longitudinal direction and prevent the stand column 120 from rotating relative to the fixed plate 112. When the stopping shaft 123 abuts against the second end of the rotation groove 153, the deck 150 may not rotate relative to the fixed plate 112 any more, i.e., the deck 150 may also be locked to be oriented in the longitudinal direction. Hence, according to the embodiments of the present disclosure, through the cooperation of the stopping shaft 123 on the stand column 120 with the rotation groove 153 in the deck 150 and the second stopping groove 113 in the fixed plate 112, it is able to automatically lock the deck 150 and the stand column 120 to be oriented in the longitudinal direction during the folding in a stable and reliable manner, thereby to improve the security.

In a possible embodiment of the present disclosure, the controller 160 includes a first control panel 161 and a second control panel 162 electrically connected to the first control panel 161. As shown in FIG. 1, the first control panel 161 is arranged in the panel 136 and coupled to the handrail motor 135. The first control panel 161 is configured to control the handrail motor 135 to drive the handrail assembly 130 to rotate or stop rotating. As shown in FIG. 2, the second control panel 162 is mounted on the chassis 110 and coupled to the pushrod motor 155. The second control panel 162 is configured to control the pushrod motor 155 to drive the deck 150 to rotate or stop rotating.

In a possible embodiment of the present disclosure, a voice controller 182, a microphone 183 and a loudspeaker 184 are arranged in the panel 136 and coupled to the controller 160 (the first control panel 161), and the microphone 183 is coupled to the voice controller 182. In this way, a user may control a running state of the treadmill 100 through a voice command. To be specific, after a voice command is given by the user, the microphone 183 may receive the voice command and transmit it to the voice controller 182. The voice controller 182 may parse the voice command, and transmit a parsed command to the controller 160 (the first control panel 161). Then, the controller 160 may control corresponding components of the treadmill in accordance with the command.

In addition, the panel 136 is further provides with a button (not shown) coupled to the first control panel 161 of the controller 160. When the button is pressed by the user, a folding command may be transmitted to the controller 160 (the first control panel 161), and the controller 160 may control the treadmill 100 to be automatically folded in accordance with the folding command.

In a possible embodiment of the present disclosure, the controller 160 may be in wireless communication with a mobile terminal, e.g., through Bluetooth or WiFi. An application for transmitting a signal to the controller 160 may be provided in the mobile terminal, so that the user may transmit a command to the controller 160 through the application.

It should be appreciated that, when the treadmill 100 needs to be folded or unfolded, the voice command may be transmitted to the controller 160 through the microphone 183 and the voice controller 182, or the command may be transmitted to the controller 160 through the button, or the command may be transmitted to the controller 160 through the application in the mobile terminal. To be specific, regardless of the voice command or the command transmitted through the button, they may be transmitted to the first control panel 161 and then the first control panel 161 may transmit a corresponding signal to the handrail motor 136 coupled thereto, so as to control the handrail motor 135 to drive the handrail 131 and the panel 136 to rotate to be in the folded state. In addition, the first control panel 161 may transmit a signal to the second control panel 162, and the second control panel 162 may control the pushrod motor 155 to drive the telescopic bracket 116 to move relative to the fixed bracket 111 and drive the deck 150 to rotate to the longitudinal direction, thereby enable the treadmill 100 to be in the folded state.

In a possible embodiment of the present disclosure, the treadmill 100 further includes a first sensor 171 and a second sensor (not shown) both coupled to the controller 160. Here, positions of the first sensor 171 and the second sensor on the treadmill will not be particularly defined herein, as long as a detection function may be achieved.

The first sensor 171 may detect whether there is a human body spaced apart from the treadmill 100 by a predetermined distance wen the treadmill 100 is to be in the folded or unfolded state and the deck 150 and the handrail assembly 130 rotate, and when there is the human body spaced apart from the treadmill 100 by the predetermined distance, transmit a corresponding first electric signal to the controller 160 (the first control panel 161). Upon the receipt of the first electric signal indicating that there is the human body surrounding the treadmill, the controller 160 may control the pushrod 155 to stop, so as to stop the rotation of the deck 150, i.e., temporarily stop the deck 150 from being folded or unfolded.

When there is no human body spaced apart from the treadmill 100 by the predetermined distance, the first sensor 171 may transmit a corresponding second electric signal to the controller 160. Upon the receipt of the second electric signal indicating that there is no human body surrounding the treadmill, the controller 160 may wait a predetermined time period, and then control the pushrod motor 155 to start so as to control the deck 150 to rotate continuously, thereby to enable the treadmill 100 to be in the folded or unfolded state.

In a possible embodiment of the present disclosure, as shown in FIG. 2, two first sensors 171 may be arranged at two ends of the chassis 110 respectively, and the first sensor 171 may be, but not limited, a pyroelectric infrared sensor.

The second sensor may detect whether the treadmill 100 is in a stable state when the treadmill is to be in the folded or unfolded state (i.e., when the deck 150 and the handrail assembly 130 rotate), and when the treadmill 100 is in an unstable state, transmit a corresponding third electric signal to the controller 160. Upon the receipt of the third electric signal, the controller 160 may control the pushrod motor 155 to stop, so as to control the deck 150 to stop rotating, i.e., to temporarily stop the deck 150 from being folded or unfolded. In addition, when the treadmill 100 is in the stable state again, the second sensor may transmit a corresponding fourth electric signal to the controller 160. Upon the receipt of the fourth electric signal, the controller 160 may transmit a corresponding command to indicate the user to perform a corresponding operation, so as to control the deck 150 to rotate continuously, thereby to enable the treadmill 100 to be in the folded or unfolded state.

In a possible embodiment of the present disclosure, the second sensor may be coupled to the first control panel 161, and it may be, but not limited to, an acceleration sensor.

In a possible embodiment of the present disclosure, the panel 136 is further provided with a control button 181 coupled to the controller 160 (the first control panel 161) and protruding out of a housing of the panel 136. The user may operate the control button 181 to control the running state of the treadmill 100. To be specific, when the control button 181 is operated by the user, a corresponding command may be transmitted to the controller 160, and the controller 160 may control the running state of the treadmill 100, e.g., a belt motor 158 may be controlled so as to stop or start a belt or control a rotation speed of the belt.

In addition, an emergency button 137 is further arranged at a low side of the panel 136. In an unexpected situation, the emergency button may be pressed to transmit a command to the controller 160, so as to stop a corresponding motor.

In the conventional treadmill, no back plate for shielding is provided at the bottom of the deck, and an internal structure of the deck is directly exposed to the outside, so the internal structure is not protected, and the appearance of the treadmill is adversely affected. In a possible embodiment of the present disclosure, the treadmill 100 further includes a back plate 190.

Figure 7:
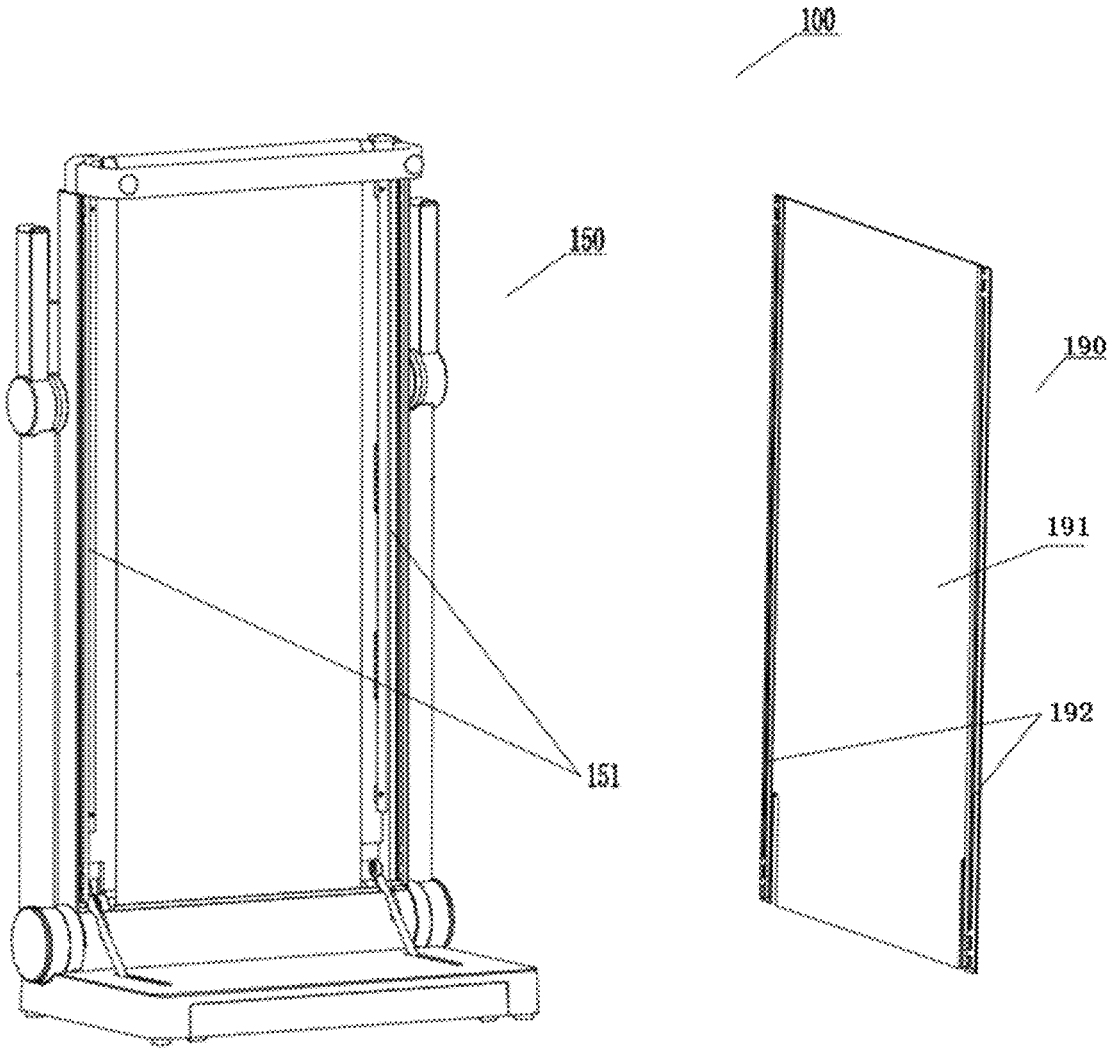
FIG. 7 is an exploded view of the deck 150 and a back plate 190 according to one embodiment of the present disclosure.
Figure 8:
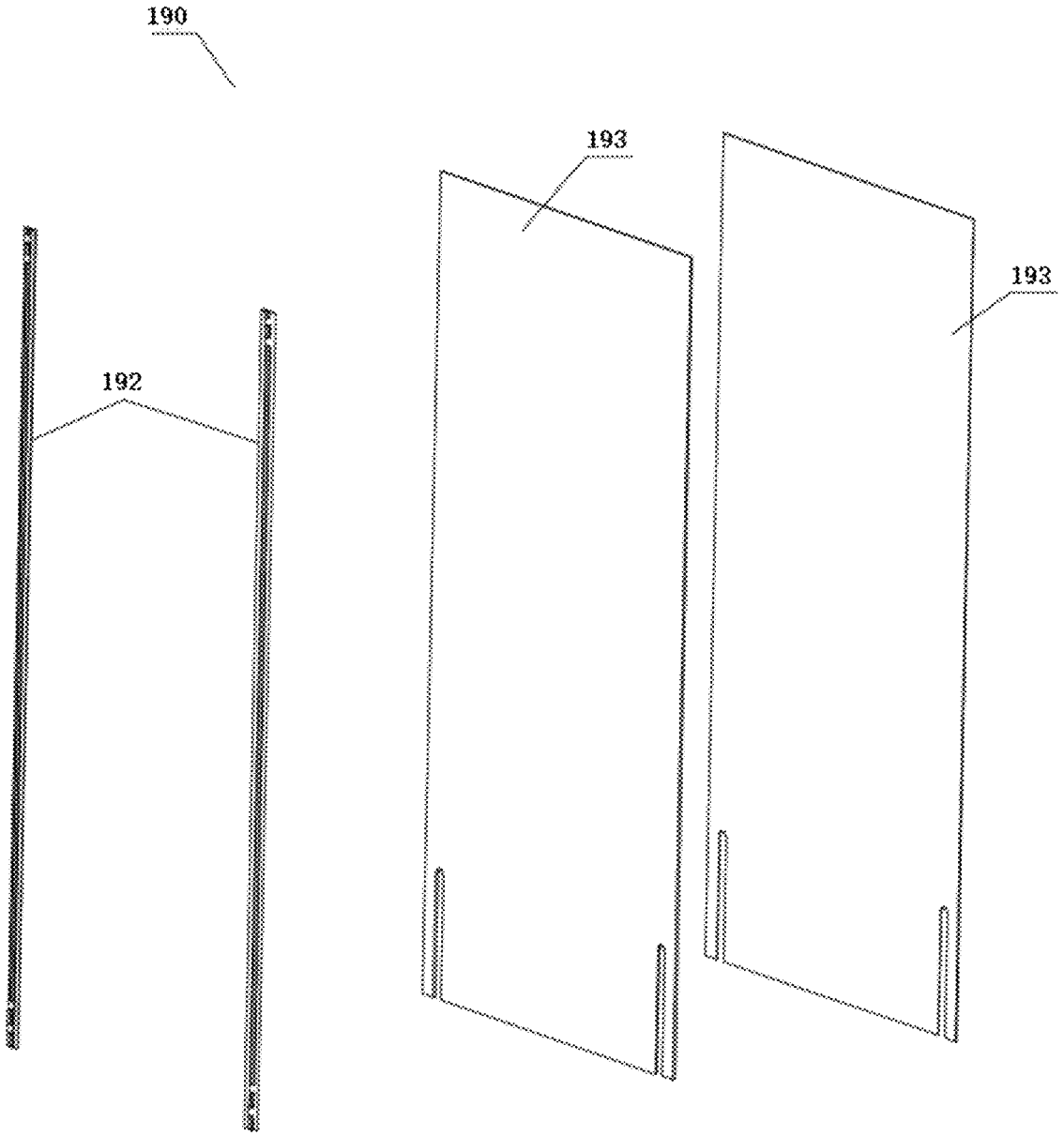
FIG. 8 is an exploded view of the back plate 190 according to one embodiment of the present disclosure.
Figure 9:
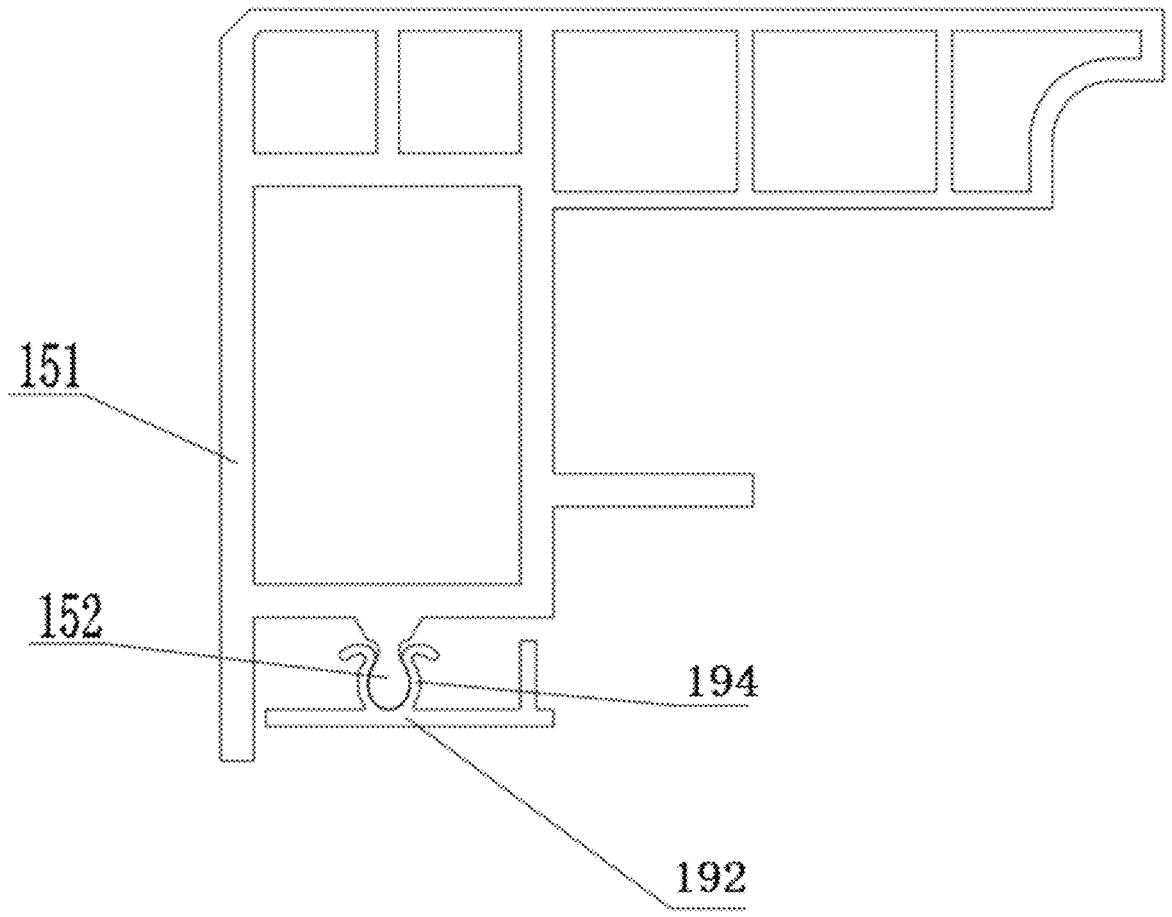
FIG. 9 is a sectional view of a structure consisting of a protrusion 152 and a fastener 192 according to one embodiment of the present disclosure.

FIG. 7 is an exploded view of the deck 150 and the back plate 190 according to one embodiment of the present disclosure, FIG. 8 is an exploded view of the back plate 190 according to one embodiment of the present disclosure, and FIG. 9 is a sectional view of a structure consisting of a protrusion 152 and a fastener 192 according to one embodiment of the present disclosure.

As shown in FIGS. 7 to 9, apart from the above-mentioned members such as the deck 150, the treadmill 100 further includes the back plate 190 mounted on the deck 150. The treadmill 100 in FIG. 7 is in the folded state. The back plate 190 is detachably mounted at a back surface of the deck 150. Through the back plate 190, it is able to shield the internal structure of the deck 150. In this way, when the deck 150 rotates to be in the folded state, it is able to improve the appearance of the treadmill.

In a possible embodiment of the present disclosure, the back plate 190 further includes a base plate 191, and a decorative layer 193 is arranged on the base plate 191. Here, the decorative layer 193 may be a cloth made of different materials and having different patterns, or a coating, which will not be particularly defined herein. It should be appreciated that, the back plate 190 may be moved from the deck 150, and then the decorative layer 193 may be replaced, so as to be adapted to different environments.

It should be appreciated that, a structure for connecting the back plate 190 and the deck 150 will not be particularly defined herein, and any known structure capable of detachably connecting the back plate 190 and the deck 150 shall fall within the scope of the present disclosure.

In a possible embodiment of the present disclosure, the back plate 190 includes the base plate 191 and the fastener 192 mounted on the base plate 191. The protrusion 152 adapted to the fastener 192 is provided at the back surface of the deck 150. Through the connection of the fastener 192 with the protrusion 152 in a snap-fit manner, the back plate 190 and the base plate 191 may be fixedly mounted on the back surface of the deck 150. In addition, when the fastener 192 is detached from the protrusion 152, the back plate 190 and the base plate 191 may be removed from the deck 150. In this way. It is able for the back plate 190 to be detachably connected to the deck 150.

Further, as shown in FIG. 7, two footrest plates 151 are arranged at two sides of the deck 150 respectively, the protrusion 152 is provided at the bottom of each footrest plate 151, and the fastener 192 adapted to the protrusion 152 is arranged at each side of the base plate 191. Through the cooperation of the fastener 192 and the corresponding protrusion 152, it is able to firmly mount the back plate 190 and the base plate 191 on the back surface of the deck 150. Here, shapes and structures of the fastener 192 and the protrusion 152 will not be particularly defined herein, as long as they may be detachably connected to each other.

In a possible embodiment of the present disclosure, the fastener 192 may be made of resilient plastics. As shown in FIG. 9, the protrusion 152 has a drop shape with two narrow ends and a wide middle portion. The fastener 192 includes a cup-like member 194 matching the protrusion 152, with one end being opened and the other end being closed. In addition, the two ends of the cup-like member 194 are narrow, and a middle portion of the cup-like member 194 is wide. When the fastener 192 is connected to the protrusion 152, an outer wall of the protrusion 152 may abut against an inner wall of the cup-like member 194. In addition, due to the narrow opened end of the cup-like member 194, it is able to prevent the cup-like member 194 from falling off from the protrusion 152 easily, thereby to improve the stability of the entire structure.

It should be appreciated that, because the fastener 192 is made of plastics, during the removal of the back plate 190, the opened end of the cup-like member 194 may be pulled outward to remove the fastener 192 from the protrusion 152, thereby to remove the back plate 190 from the deck 150.

It should be further appreciated that, the fastener 192 may include one or more cup-like members 194, and correspondingly, the footrest plate 151 may be provided with one or more protrusions 152. Here, the arrangement of the cup-like members 194 and the protrusions 152 will not be particularly defined herein, as long as the back plate 190 may be firmly mounted on the deck 150 through the cooperation of cup-like members 194 with the protrusions 152.

Unless otherwise specified, such words as "fix" and "connect" may have a general meaning. In addition, such words as "upper", "lower", "inner", "outer", "top" and "bottom" are used to indicate directions or positions as viewed in the drawings, and they are merely used to facilitate the description in the present disclosure, rather than to indicate or imply that a device or member must be arranged or operated at a specific position.

Such expressions as "one embodiment", "embodiments" and "examples" intend to indicate that the features, structures or materials are contained in at least one embodiment or example of the present disclosure, rather than referring to an identical embodiment or example. In addition, the features, structures or materials may be combined in any embodiment or embodiments in an appropriate manner. In the case of no conflict, the embodiments or examples or the features therein may be combined in any form.

The above embodiments are for illustrative purposes only, but the present disclosure is not limited thereto. Obviously, a person skilled in the art may make further modifications and improvements without departing from the spirit of the present disclosure, and these modifications and improvements shall also fall within the scope of the present disclosure.

What is claimed is:

1. A treadmill, comprising a chassis, stand columns mounted at both sides of the chassis, each stand column is rotatably connected to the chassis and configured to rotate by a predetermined angle relative to the chassis, a deck rotatably mounted on the chassis and configured to rotate relative to the chassis to a longitudinal direction or a horizontal direction, wherein each stand column is oriented in a predetermined direction angled relative to the longitudinal direction at the predetermined angle when the deck is oriented in the horizontal direction, a handrail assembly rotatably mounted on the stand columns and configured to rotate relative to the stand columns to a folded state or an unfolded state, and a controller configured to control rotation of the deck and the handrail assembly, wherein the controller is configured to control the deck to rotate to the longitudinal direction when the controller controls the handrail assembly to rotate relative to the stand columns to be in the folded state, and control the handrail assembly to rotate relative to the stand columns to be in the unfolded state when the controller controls the deck to rotate from the longitudinal direction to the horizontal direction, when the controller controls the deck to rotate to the longitudinal direction and the deck has rotated from the horizontal direction to the predetermined direction, the deck is configured to drive the stand columns and the handrail assembly on the stand columns to rotate synchronously by the predetermined angle to the vertical direction, wherein a fixed plate is arranged on the chassis, a second stopping groove is provided in the fixed plate, a rotation groove is provided in the deck, and the stand column is provided with a stopping shaft;

the stopping shaft penetrates through the second stopping groove into the rotation groove, and is configured to rotate relative to the second stopping groove and the rotation groove;

when the deck rotates from the horizontal direction to the predetermined direction relative to the stand column and the stopping shaft, the stopping shaft moves from a first end of the rotation groove to a second end of the rotation groove and abuts against the second end, so that the deck pushes the stand column to rotate synchronously; and when the deck pushes the stand column to rotate from the predetermined direction to the longitudinal direction, the stopping shaft rotates from the first end of the second stopping groove to the second end of the second stopping groove.

2. The treadmill according to claim 1, further comprising a handrail motor coupled to the handrail assembly and configured to drive the handrail assembly to rotate, and a pushrod motor coupled to the deck and configured to drive the deck to rotate, wherein the controller comprises a first control panel coupled to the handrail motor and configured to control the handrail motor so that the handrail motor drives the handrail assembly to rotate, and a second control panel coupled to the first control panel and the pushrod motor and configured to control the pushrod motor so that the pushrod motor drives the deck to rotate.

3. The treadmill according to claim 2, further comprising a first sensor coupled to the controller and configured to detect whether there is a human body spaced apart from the treadmill by a predetermined distance when the deck rotates, and when there is the human body spaced apart from the treadmill by the predetermined distance, transmit a corresponding electric signal to the controller so that the controller controls the deck to stop rotating.

4. The treadmill according to claim 3, wherein the first sensor is further configured to, when there is no human body spaced apart from the treadmill by the predetermined distance, transmit the first electric signal to the controller, and the controller is further configured to wait a predetermined time period and control the deck to rotate continuously upon the receipt of the first electric signal.

5. The treadmill according to claim 4, further comprising a second sensor coupled to the controller and configured to detect whether the treadmill is in a stable state when the deck rotates, and when the treadmill is in an unstable state, transmit a second electric signal to the controller so that the controller controls the deck to stop rotating.

6. The treadmill according to claim 5, further comprising a microphone configured to receive a voice command, and a voice controller coupled to the microphone and the controller and configured to parse the voice command received by the microphone and transmit the parsed voice command to the controller so that the controller controls the treadmill in accordance with the parsed voice command.

7. The treadmill according to claim 6, wherein a support plate is arranged at an upper end of each stand column, and the handrail assembly comprises a handrail mounted on the support plate and configured to rotate relative to the support plate, and a panel comprising a panel bracket, wherein a toothed disc is secured onto the panel bracket, rotatably connected to the support plate, and configured to drive the panel bracket and the panel to rotate relative to the support plate, wherein the handrail motor is fixedly mounted on the handrail, connected to the toothed disc, and configured to drive the handrail and the toothed disc to rotate in opposite directions.

8. The treadmill according to claim 7, wherein an arc-like stopping hole is provided in the support plate, and a stopping rod is fixedly mounted on the handrail, wherein when the handrail rotates relative to the support plate, the stopping rod is configured to move along the stopping hole to abut against any one of two ends of the stopping hole.

9. The treadmill according to claim 8, wherein a stopping stud is fixedly mounted on the support plate, and a first stopping groove is formed in the toothed disc, wherein when the toothed disc rotates relative to the support plate, the stopping stud is configured to move along the first stopping groove to abut against any one of two ends of the first stopping groove.

10. The treadmill according to claim 9, further comprising a back plate detachably mounted on the deck, wherein the back plate comprises a base plate provided with a decorative layer, a protrusion is provided at a back surface of the deck, and a fastener is provided on the base plate and connected to the protrusion in a snap-fit manner to fixedly mount the base plane on the back surface of the deck.

11. The treadmill according to claim 10, wherein footrest plates are arranged at two sides of the deck respectively, the protrusion is provided at a bottom of each footrest plate, and the fasteners adapted to the protrusions are mounted at two sides of the base plate respectively.

12. The treadmill according to claim 11, wherein the fastener is made of plastics, the protrusion has a drop-like cross section, and the fastener is configured to surround the protrusion and abut against the protrusion.

13. The treadmill according to claim 12, wherein the chassis comprises a fixed bracket, and a telescopic bracket slidably mounted on the fixed bracket and configured to move horizontally relative to the fixed bracket, wherein the deck is rotatably mounted on the fixed bracket and connected to the telescopic bracket through a connection rod, and the telescopic rod is configured to drive the deck to rotate relative to the fixed bracket through the connection rod when the telescopic rod moves horizontally relative to the fixed bracket.

14. The treadmill according to claim 13, wherein the pushrod motor is fixedly mounted on the fixed bracket, connected to the telescopic bracket, and configured to drive the telescopic bracket to move horizontally relative to the fixed bracket.

* * * * *